US012409367B2

(12) United States Patent
Ban

(10) Patent No.: US 12,409,367 B2
(45) Date of Patent: Sep. 9, 2025

(54) GOLF CLUB HEAD

(71) Applicant: BRIDGESTONE SPORTS CO., LTD., Tokyo (JP)

(72) Inventor: Wataru Ban, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 10 days.

(21) Appl. No.: 18/076,533

(22) Filed: Dec. 7, 2022

(65) Prior Publication Data

US 2023/0191209 A1 Jun. 22, 2023

(30) Foreign Application Priority Data

Dec. 22, 2021 (JP) ..... 2021-208410

(51) Int. Cl.
*A63B 53/04* (2015.01)

(52) U.S. Cl.
CPC ..... *A63B 53/0445* (2020.08); *A63B 53/0408* (2020.08); *A63B 53/0458* (2020.08)

(58) Field of Classification Search
CPC ..... A63B 53/0445; A63B 53/0458
See application file for complete search history.

(56) References Cited

U.S. PATENT DOCUMENTS

| | | | | |
|---|---|---|---|---|
| 8,827,833 | B2 * | 9/2014 | Amano | A63B 53/047 473/331 |
| 8,979,670 | B2 | 3/2015 | Aguayo et al. | |
| 9,539,477 | B2 * | 1/2017 | Ripp | A63B 53/047 |
| 10,350,467 | B2 * | 7/2019 | Ban | A63B 53/047 |
| 10,894,192 | B2 * | 1/2021 | Ban | A63B 53/04 |
| 2005/0113186 | A1 | 5/2005 | Newman et al. | |
| 2011/0269567 | A1 | 11/2011 | Ban et al. | |
| 2015/0024868 | A1 | 1/2015 | Simone | |
| 2016/0361607 | A1 * | 12/2016 | Huang | A63B 53/04 |
| 2019/0388741 | A1 | 12/2019 | Ban | |
| 2019/0388742 | A1 | 12/2019 | Ban | |
| 2021/0299524 | A1 | 9/2021 | Doi et al. | |

FOREIGN PATENT DOCUMENTS

| | | | |
|---|---|---|---|
| JP | 2011-234749 | A | 11/2011 |
| JP | 2014-030566 | A | 2/2014 |
| JP | 2016-503664 | A | 2/2016 |
| JP | 2017-077274 | A | 4/2017 |
| JP | 2019-217195 | A | 12/2019 |
| JP | 2019-217196 | A | 12/2019 |
| JP | 2020-120712 | A | 8/2020 |

OTHER PUBLICATIONS

Communication issued Jun. 20, 2025 in Japanese Application No. 2021-208410.

* cited by examiner

*Primary Examiner* — Raeann Gorden
(74) *Attorney, Agent, or Firm* — Sughrue Mion, PLLC

(57) ABSTRACT

The golf club head includes a face portion, a plurality of score lines formed in the face portion and extending in a toe-heel direction, and a plurality of convex portions formed in the face portion, projecting from reference plane which includes edges of each of the plurality of score lines, and extending in the toe-heel direction. The plurality of convex portions include a first convex portion and a second convex portion formed between adjacent score lines. A projecting height of the first convex portion and/or a width in an orthogonal direction of the toe-heel direction of the first convex portion is larger than that of the second convex portion.

11 Claims, 11 Drawing Sheets

GOLF CLUB HEAD

CROSS-REFERENCE TO RELATED APPLICATION(S)

This application claims priority to and the benefit of Japanese Patent Application No. 2021-208410 filed on Dec. 22, 2021, the entire disclosure of which is incorporated herein by reference.

BACKGROUND OF THE INVENTION

Field of the Invention

The present invention relates to a golf club head.

Description of the Related Art

There has been known a technique of improving the spin performance of a struck golf ball by score lines or grooves thinner than score lines on a face portion (for example, Japanese Patent Laid-Open Nos. 2019-217196 and 2019-217195).

However, the related art has room for improvement in terms of the spin performance of the face portion.

SUMMARY OF THE INVENTION

It is an object of the present invention to improve the spin performance of the face portion.

According to one aspect of the present invention, there is provided a golf club head comprising:

- a face portion;
- a plurality of score lines formed in the face portion and extending in a toe-heel direction; and
- a plurality of convex portions formed in the face portion, projecting from reference plane which includes edges of each of the plurality of score lines, and extending in the toe-heel direction,
- wherein the plurality of convex portions include a first convex portion and a second convex portion formed between adjacent score lines, and
- a projecting height of the first convex portion and/or a width in an orthogonal direction of the toe-heel direction of the first convex portion is larger than that of the second convex portion.

Further features of the present invention will become apparent from the following description of exemplary embodiments (with reference to the attached drawings).

DESCRIPTION OF THE EMBODIMENTS

Figure 1:
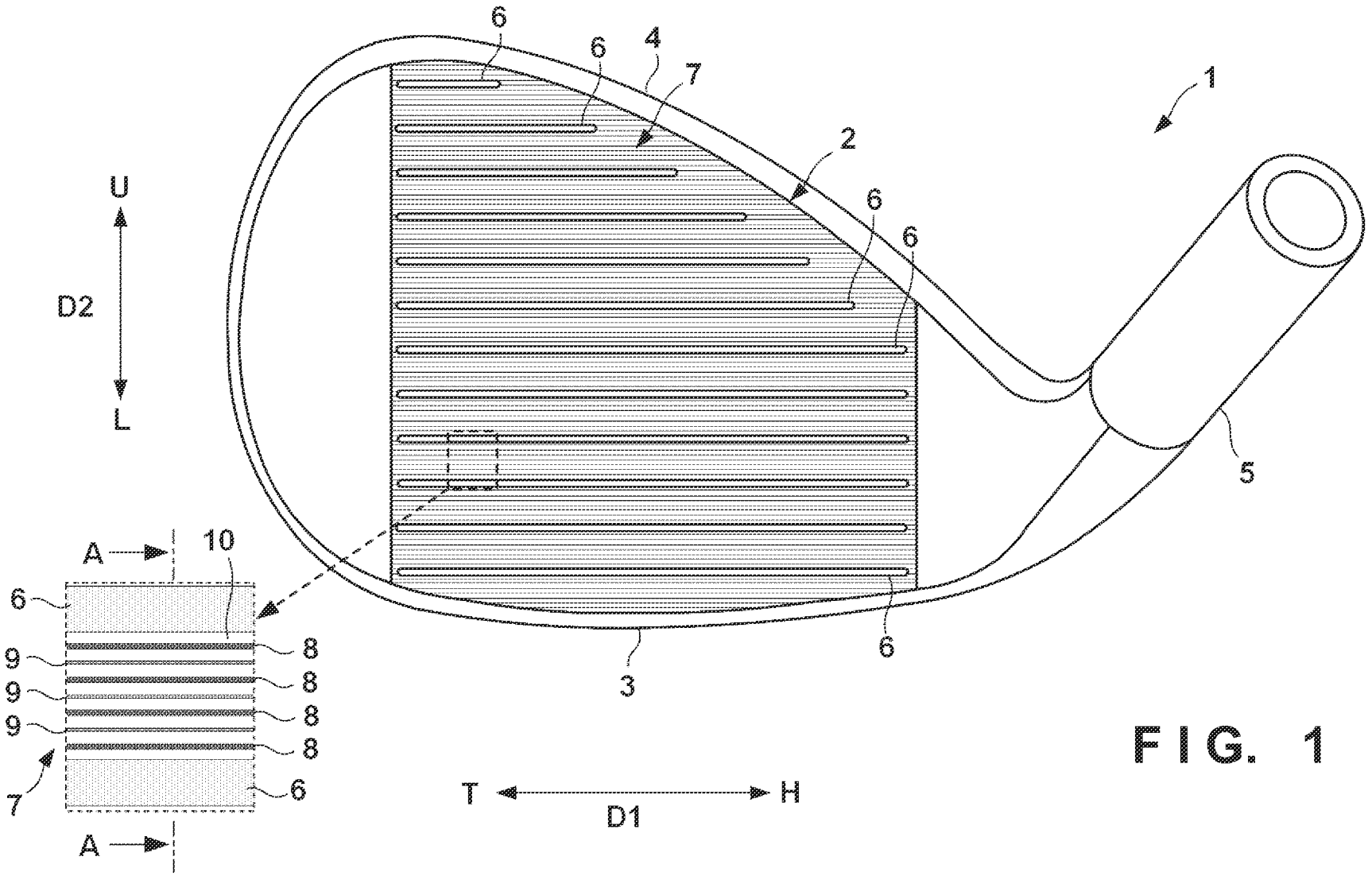
FIG. 1 shows an external view and a partial enlarged view of a golf club head according to an embodiment of the present invention.

Hereinafter, embodiments will be described in detail with reference to the attached drawings. Note that the following embodiments are not intended to limit the scope of the claimed invention, and limitation is not made an invention that requires all combinations of features described in the embodiments. Two or more of the multiple features described in the embodiments may be combined as appropriate. Furthermore, the same reference numerals are given to the same or similar configurations, and redundant description thereof is omitted.

First Embodiment

FIG. 1 shows an external view and a partial enlarged view of a golf club head 1 according to an embodiment of the present invention. FIG. 1 illustrates an example in which the present invention is applied to an iron type golf club head. The present invention is suitable for an iron type golf club head and, more particularly, for middle iron, short iron, and wedge type golf club heads. More specifically, the present invention is suitable for manufacturing a golf club head with a loft angle of 30° (inclusive) to 70° (inclusive) and a head weight of 240 g (inclusive) to 320 g (inclusive). However, the present invention is also applicable to wood type and utility (hybrid) type golf club heads.

The golf club head 1 includes a face portion 2 and a hosel portion 5. The face portion 2 forms a striking surface for striking a golf ball. A shaft (not shown) is attached to the hosel portion 5. In FIG. 1, an arrow D1 indicates a toe-heel direction, and reference symbols T and H indicate the toe side and the heel side, respectively. An arrow D2 indicates a vertical direction (a direction between a top line 4 and a leading edge 3) orthogonal to the D1 direction and along the face portion 2. Reference symbols U and L indicate the upper side (top line 4 side) and the lower side (leading edge 3 side), respectively, upon grounding the sole portion of the head 1.

Figure 2:
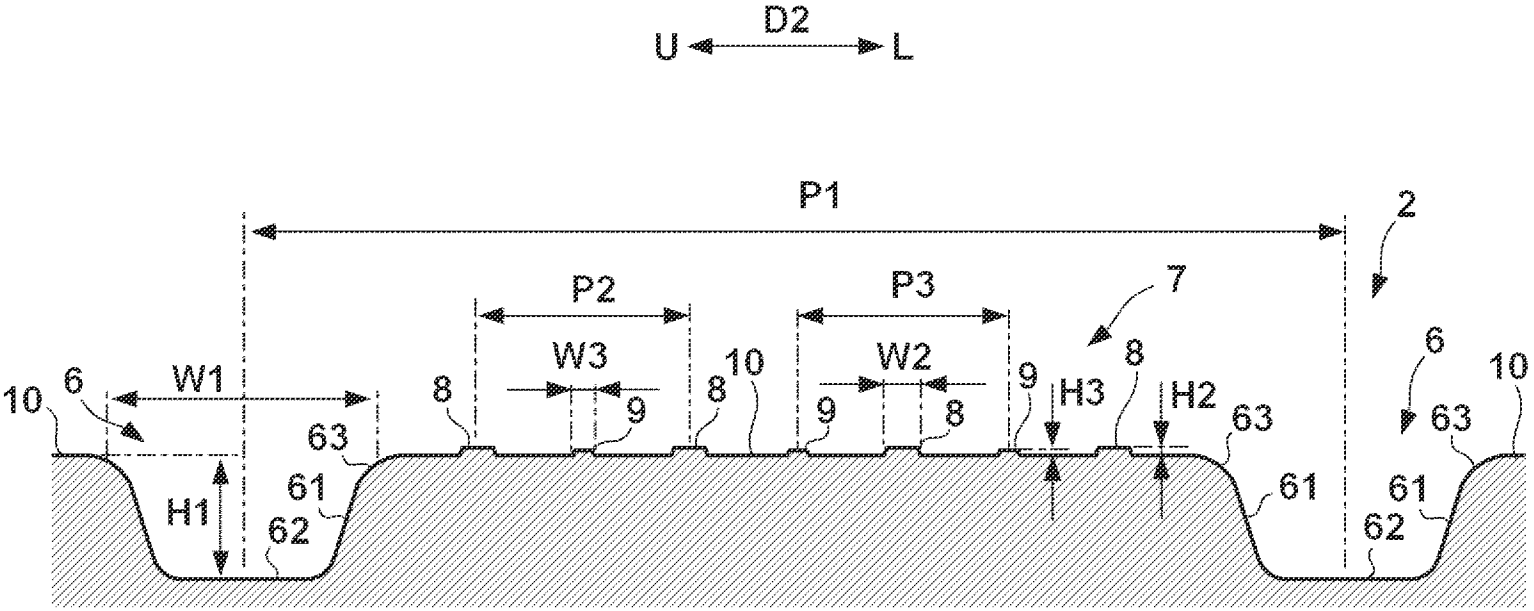
FIG. 2 is a sectional view of the golf club head taken along a line A-A in FIG. 1.

A plurality of score lines 6 and a plurality of convex portions 7 are formed in the face portion 2. The score lines 6 and the convex portions 7 will be described with reference to FIG. 2 in addition to FIG. 1. FIG. 2 is a sectional view taken along a line A-A in FIG. 1. This is a sectional view of the golf club head 1 showing the structures of adjacent two score lines 6 and the structure between these score lines 6.

Each score line 6 is a straight groove extending in the D1 direction. The plurality of score lines 6 are aligned parallel to each other in the D2 direction. Although the score lines 6 are aligned at equal intervals (equal pitches) in this embodiment, they may be aligned at different intervals. In this embodiment, each score line 6 has the same cross-sectional shape throughout its entire longitudinal portion except for its two ends (toe- and heel-side ends). Also, the score lines 6 have the same cross-sectional shape.

Each score line 6 includes a pair of side walls (side portions) 61 and a bottom wall (bottom portion) 62, and has a trapezoidal cross-sectional shape bilaterally symmetric about a center line in the D2 direction. Note that the cross-sectional shape of the score line 6 is not limited to a trapezoidal shape, and may be other shapes such as a V shape. Rounded portions are formed on edge portions 63 of each score line 6. The radius of the rounded portion is, for example, 0.05 mm (inclusive) to 0.3 mm (inclusive). The face portion 2 includes a reference plane 10. The reference plane 10 is a flat plane and includes the edge of each edge portion 63 of the score line 6. In other word, a virtual plane including the edge of each edge portion 63 is the reference plane 10.

A depth H1 of the score line 6 (the distance between the bottom wall 62 and the reference plane 10) is preferably 0.3 mm or more. When the golf club head 1 is intended for athletics, the depth H1 is set to 0.5 mm or less to comply with a relevant rule. A width W1 (the width defined by the 30-degree measurement rule) of the score line 6 is preferably 0.6 mm or more. When the golf club head 1 is intended for athletics, the width W1 is set to 0.9 mm or less to comply with a relevant rule.

The plurality of convex portions 7 are formed over the entire region of the face portion 2. Each convex portion projects from the reference plane 10, and extends linearly in the D1 direction parallel to the score line 6. In this embodiment, each convex portion projects from the reference plane 10 in the normal direction of the reference plane 10. The plurality of convex portions 7 are aligned parallel to each other in the D2 direction. At the time of striking a golf ball, its surface is readily caught between the adjacent convex portions, so that the spin performance of the golf ball can be improved.

In this embodiment, the plurality of convex portions 7 include two kinds of convex portions, that is, a convex portion 8 and a convex portion 9 having different specifications. In other words, the convex portion 7 is a general term for the convex portion 8 and the convex portion 9. In this embodiment, the plurality of convex portions 7 include these two kinds of convex portions alone, but may include three or more kinds of convex portions. Four arrays of convex portions 8 and three arrays of convex portions 9 are formed between two score lines 6 adjacent to each other in the D2 direction. In other words, seven arrays of convex portions 7 in total are formed between the two score lines 6 adjacent to each other in the D2 direction. The number of convex portions 7 formed between two score lines 6 adjacent to each other in the D2 direction is five to nine, and preferably seven to nine.

In this embodiment, four arrays of convex portions 8 and three arrays of convex portions 9 are formed in the same alignment structure between arbitrary two score lines 6 adjacent to each other in the D2 direction. A deviation of the spin performance depending on the striking position in the face portion 2 can be suppressed.

As shown in FIG. 2, the cross-sectional shape of each of the convex portion 8 and the convex portion 9 along a cutting line in the D2 direction is a trapezoid. However, the cross-sectional shape of each of the convex portion 8 and the convex portion 9 may be another shape such as a triangle, a rectangle, or a circular arced shape. A width W2 of the convex portion 8 in the D2 direction and a width W3 of the convex portion 9 in the D2 direction have a relationship expressed by W2>W3. A projecting height H2 of the convex portion 8 from the reference plane 10 to its top and a projecting height H3 of the convex portion 9 from the reference plane 10 to its top have a relationship expressed by H2>H3. In this manner, both the projecting height and the width in the D2 direction of the convex portion 8 are larger than those of the convex portion 9. Since the convex portion 8 and the convex portion 9 having different projecting heights and widths are formed, it is possible to improve the drainage performance and prevent clogging of grass and the like. Thus, the spin performance can be further improved.

Each of the widths W2 and W3 is, for example, 30 μm to 150 μm. The ratio of the widths W2 and W3 is, for example, $1.2 \leq W2/W3 \leq 2.5$. Each of the projecting heights H2 and H3 is, for example, 10 μm to 25 μm. The ratio of the projecting heights H2 and H3 is, for example, $1.1 \leq H2/H3 \leq 1.5$.

In this embodiment, alignment pitches P2 of the convex portions 8 are equal pitches, and the alignment pitch P2 is, for example, 500 μm≤P2≤1500 μm. In this embodiment, alignment pitches P3 of the convex portions 9 are equal pitches, and the alignment pitch P3 is, for example, 500 μm≤P3≤1500 μm. The convex portion 8 and the convex portion 9 adjacent to each other in the D2 direction are aligned at an equal interval (pitch).

In this embodiment, the convex portions 8 and the convex portions 9 are alternately formed in the D2 direction between the adjacent score lines 6. A deviation of the spin performance depending on the striking position in the face portion 2 can be suppressed.

Second Embodiment

Figure 3A:
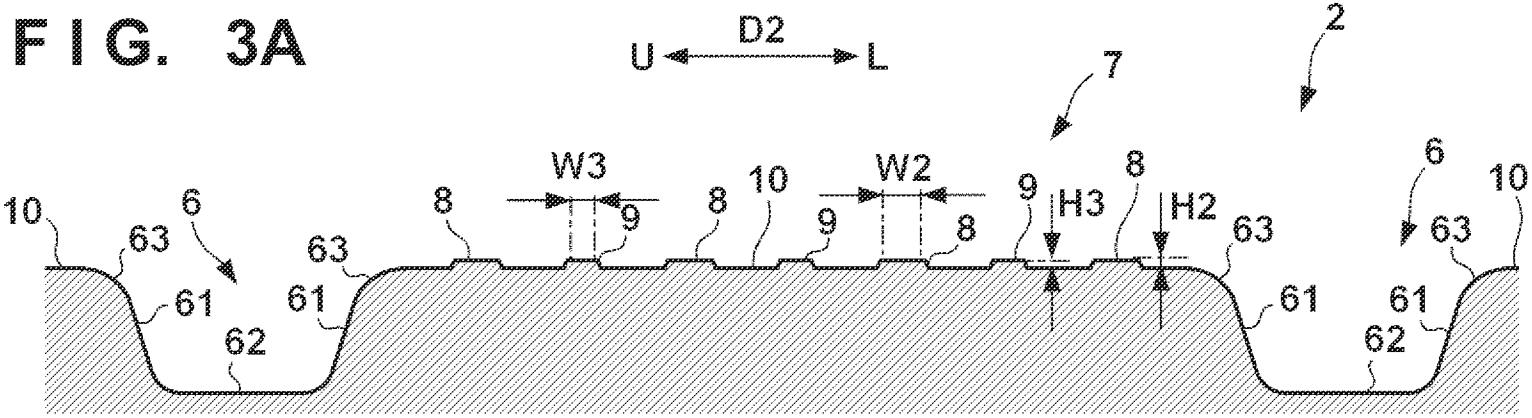
FIGS. 3A and 3B are sectional views each showing another arrangement example of convex portions.

In the first embodiment, both the projecting height and the width in the D2 direction of the convex portion 8 are larger than those of the convex portion 9. However, one of the projecting height and the width in the D2 direction of the convex portion 8 may be larger than that of the convex portion 9. In the example shown in FIG. 3A, the relationship between a projecting height H2 of a convex portion 8 and a projecting height H3 of a convex portion 9 is expressed by H2=H3. On the other hand, the relationship between a width W2 of the convex portion 8 and a width W3 of the convex portion 9 is expressed by W2>W3.

Figure 3B:
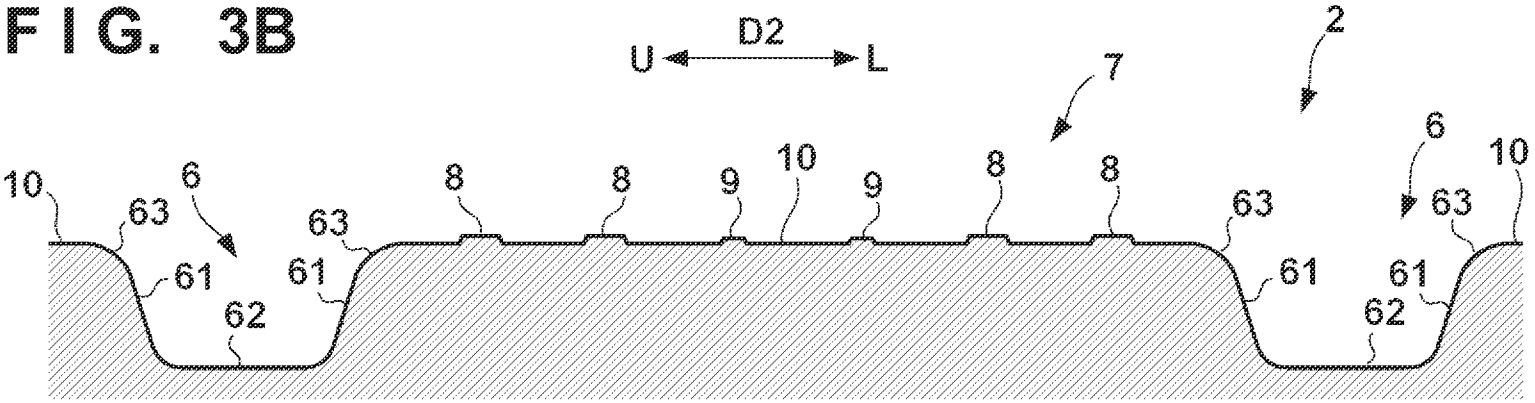

Further, in the first embodiment, the convex portions 8 and the convex portions 9 are alternately formed in the D2 direction between the adjacent score lines 6. However, various alignment modes can be adopted as the alignment mode of the convex portions 8 and the convex portions 9. In the example shown in FIG. 3B, a plurality of convex portions 8 and a plurality of convex portions 9 are formed so as to be aligned in a D2 direction. More specifically, the convex portions 8 and the convex portions 9 are aligned in the order of the convex portion 8→the convex portion 8→the convex portion 9→the convex portion 9→the convex portion 8→the convex portion 8 from the side of a top line 4 in the D2 direction. Since the convex portions 9 are arranged continuously in the D2 direction, it is possible to improve the drainage performance and prevent clogging of grass and the like between the convex portions.

Third Embodiment

Figure 4:
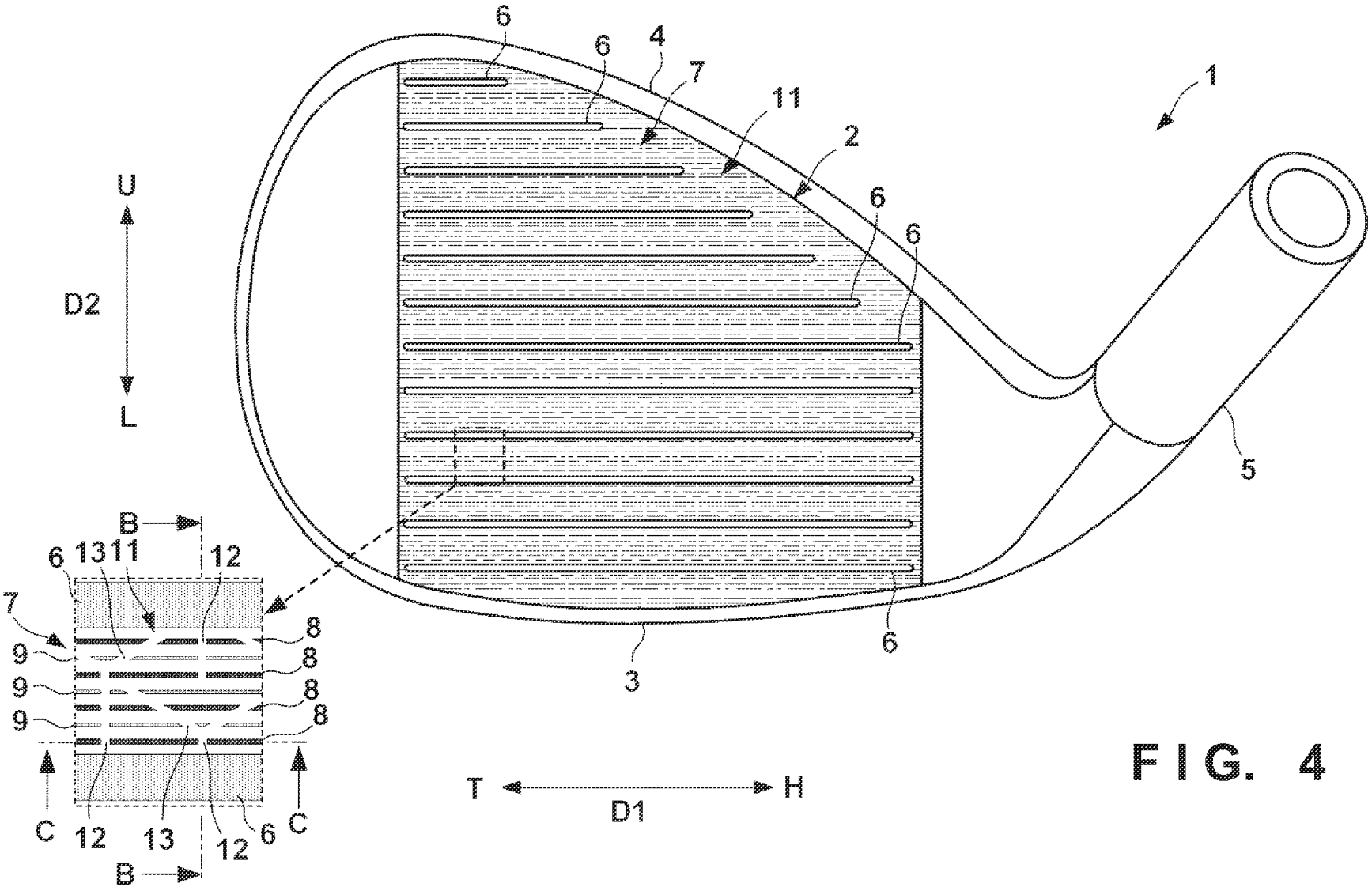
FIG. 4 shows an external view and a partial enlarged view of a golf club head according to another embodiment.

In FIG. 4, a plurality of concave portions 11 recessed on the side of a reference plane 10 in the projecting height direction of a convex portion 7 are formed in a plurality of convex portions 7. The concave portions 11 include a concave portion 12 formed in a convex portion 8, and a concave portion 13 formed in a convex portion 9. In other words, the concave portion 11 is a general term for the concave portion 12 and the concave portion 13. Since a droplet attached on a face portion 2 passes through the concave portion 11 and traverses the convex portion 7, the drainage performance of the face portion 2 can be improved. The improvement in the drainage performance of the face portion 2 enhances the spin performance (the effect of suppressing a decrease in spin amount) in, for example, rainy weather.

Figure 5A:
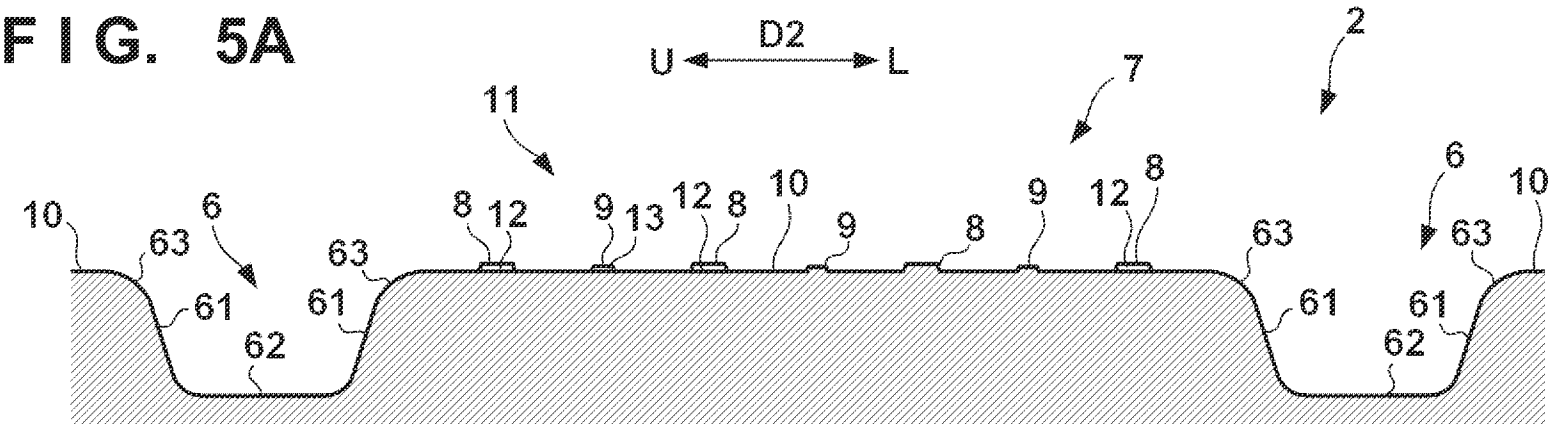
FIG. 5A is a sectional view taken along a line B-B in FIG. 4.
Figure 5B:
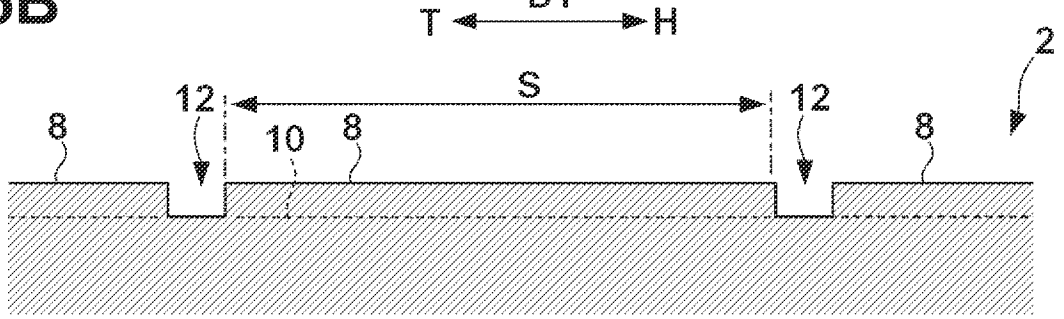
FIG. 5B is a sectional view taken along a line C-C in FIG. 4.

FIG. 5A is a sectional view taken along a line B-B in FIG. 4, and FIG. 5B is a sectional view taken along a line C-C in FIG. 4. In this embodiment, the depth of the concave portion 12 is equal to the projecting height of the convex portion 8. Accordingly, the bottom surface of the concave portion 12 is located on the same plane as the reference plane 10, and the concave portion 12 divides the convex portion 8 halfway in a D1 direction. Similarly, the depth of the concave portion 13 is equal to the projecting height of the convex portion 9. Accordingly, the bottom surface of the concave portion 13 is located on the same plane as the reference plane 10, and the concave portion 13 divides the convex portion 9 halfway in the D1 direction. Since the bottom surface of each of the concave portion 12 and the concave portion 13 is located on the same plane as the reference plane 10, the drainage performance for droplets attached on the face portion 2 and stored between adjacent convex portions can be improved.

As shown in FIG. 5B, a distance S in the D1 direction between arbitrary concave portions 12 adjacent to each other on the same convex portion 8 is preferably 10 mm or less. It is possible to suppress the deviation of the drainage performance in the toe-heel direction. Similarly, although not shown in FIG. 5B, for the concave portion 13, the distance in the D1 direction between arbitrary concave portions 13 adjacent to each other on the same convex portion 9 is preferably 10 mm or less. The width of each of the concave portion 12 and the concave portion 13 in a D2 direction is, for example, 15 μm (inclusive) to 100 μm (inclusive).

Figure 6A:
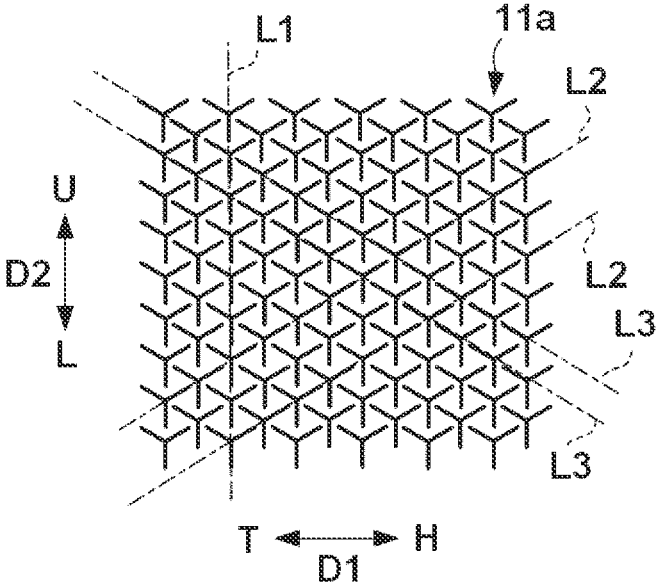
FIG. 6A is a view showing a basic pattern of a plurality of concave portions.

The plurality of concave portions 11 are formed in a continuous pattern over the entire region of the face portion 2. Since the plurality of concave portions 11 are formed in the continuous pattern, the drainage performance of the face portion 2 can be made uniform, and a deviation of the spin performance depending on the striking position in the face portion 2 can be suppressed. The design of the face portion 2 can also be improved. FIG. 6A shows the basic pattern. The pattern in this embodiment is formed by using a symbol 11*a* as one unit and arranging the symbols 11*a* regularly in the D1 direction and the D2 direction. The concave portions 11 are formed in portions where this pattern overlaps the plurality of convex portions 7.

The symbol 11*a* is formed in a Y shape constituted by a vertical straight line extending in the D2 direction and two inclined straight lines branching from the vertical straight line and inclined in opposite directions. Accordingly, each of the plurality of concave portions 11 is located on any of a virtual line L1 overlapping the vertical straight line and virtual lines L2 and L3 overlapping the inclined straight lines. Note that the virtual line L2 is a virtual line inclined from the toe side to the heel side from the side of a leading edge 3 toward the side of a top line 7. The virtual line L3 is a virtual line inclined from the heel side to the toe side from the side of the leading edge 3 toward the side of the top line 4 and intersecting the virtual line L2. Even when striking a ball with a golf club head 1 while opening or closing the face portion 2 with respect to the target direction, a large change in the drainage performance of the face portion 2 can be prevented. In addition, when striking a ball while opening or closing the face portion 2 with respect to the target direction, the golf ball is easily caught by the edge of the concave portion 11, so that the spin performance can be improved.

Fourth Embodiment

Figure 6B:
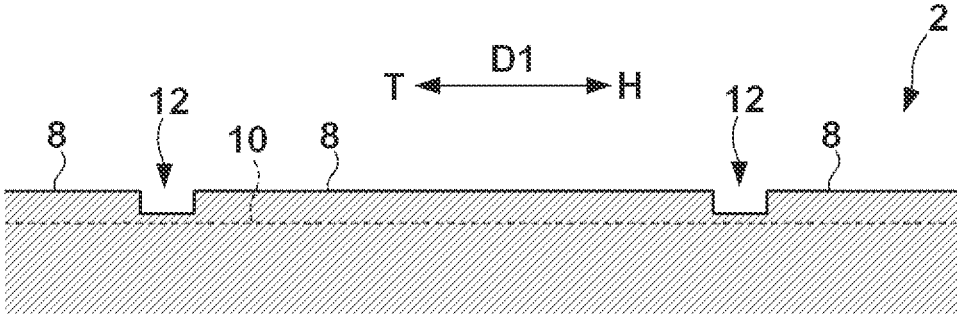
FIG. 6B is a sectional view showing another example of the depth of a concave portion.

In the third embodiment, the depth of the concave portion 12 is equal to the projecting height of the convex portion 8. However, the depth of the concave portion 12 may be smaller than the projecting height of the convex portion 8. FIG. 6B is a sectional view showing this example, and corresponds to a sectional view taken along the line C-C in FIG. 4. In the example shown in FIG. 6B, the bottom surface of a concave portion 12 is located at a position higher than a reference plane 10 (a position on the top side of a convex portion 8). Since the convex portion 8 is continuous in a D1 direction with no interruption, when striking a ball while facing a face portion 2 toward the target direction, the spin performance can be improved while maintaining the drainage performance by the concave portion 12. Although not shown, the depth of a concave portion 13 may also be smaller than the projecting height of a convex portion 9. The concave portion 12 and the concave portion 13 may have different depths.

Fifth Embodiment

Figure 7:
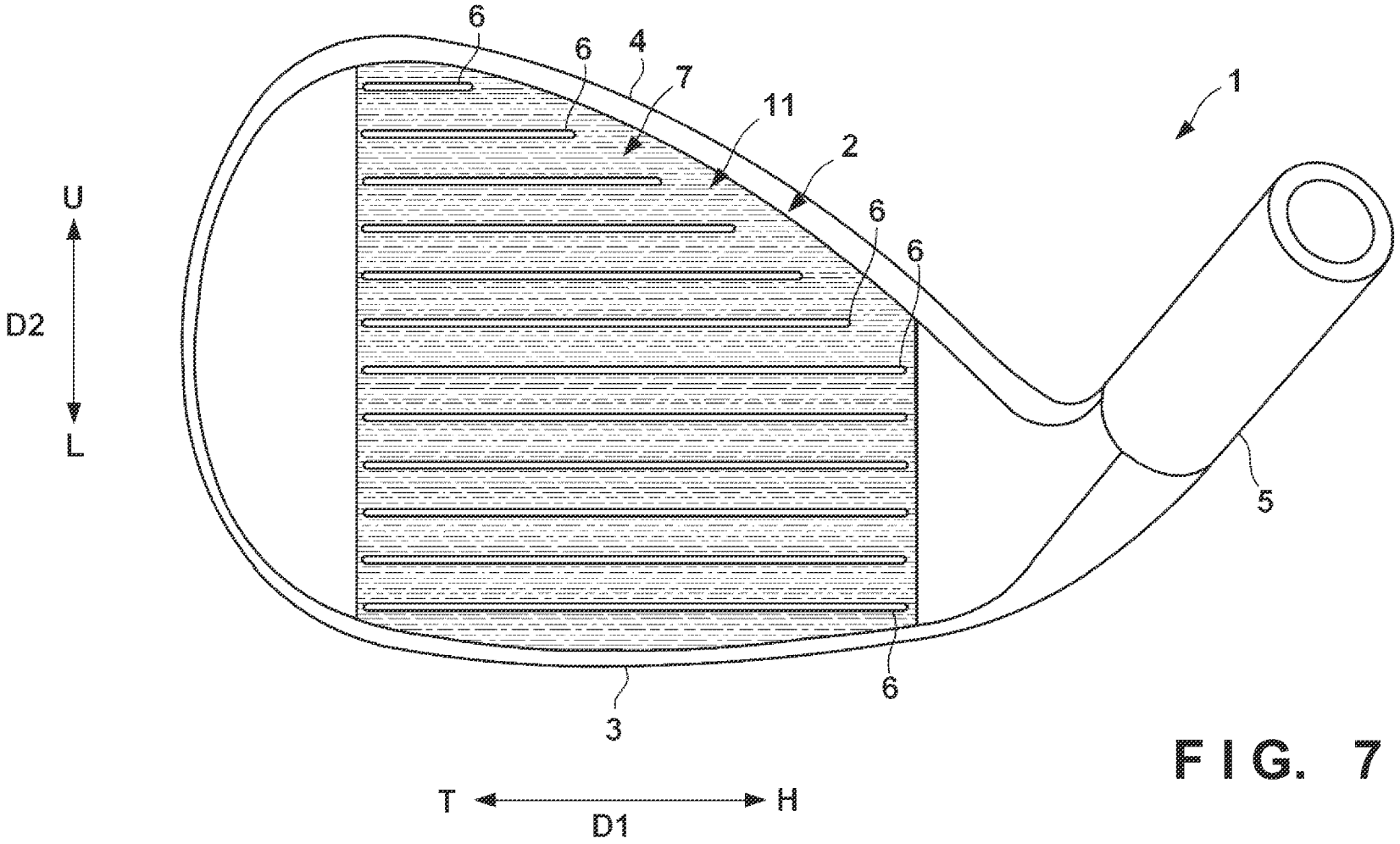
FIG. 7 is an external view of a golf club head having different basic pattern of concave portions.
Figure 8:
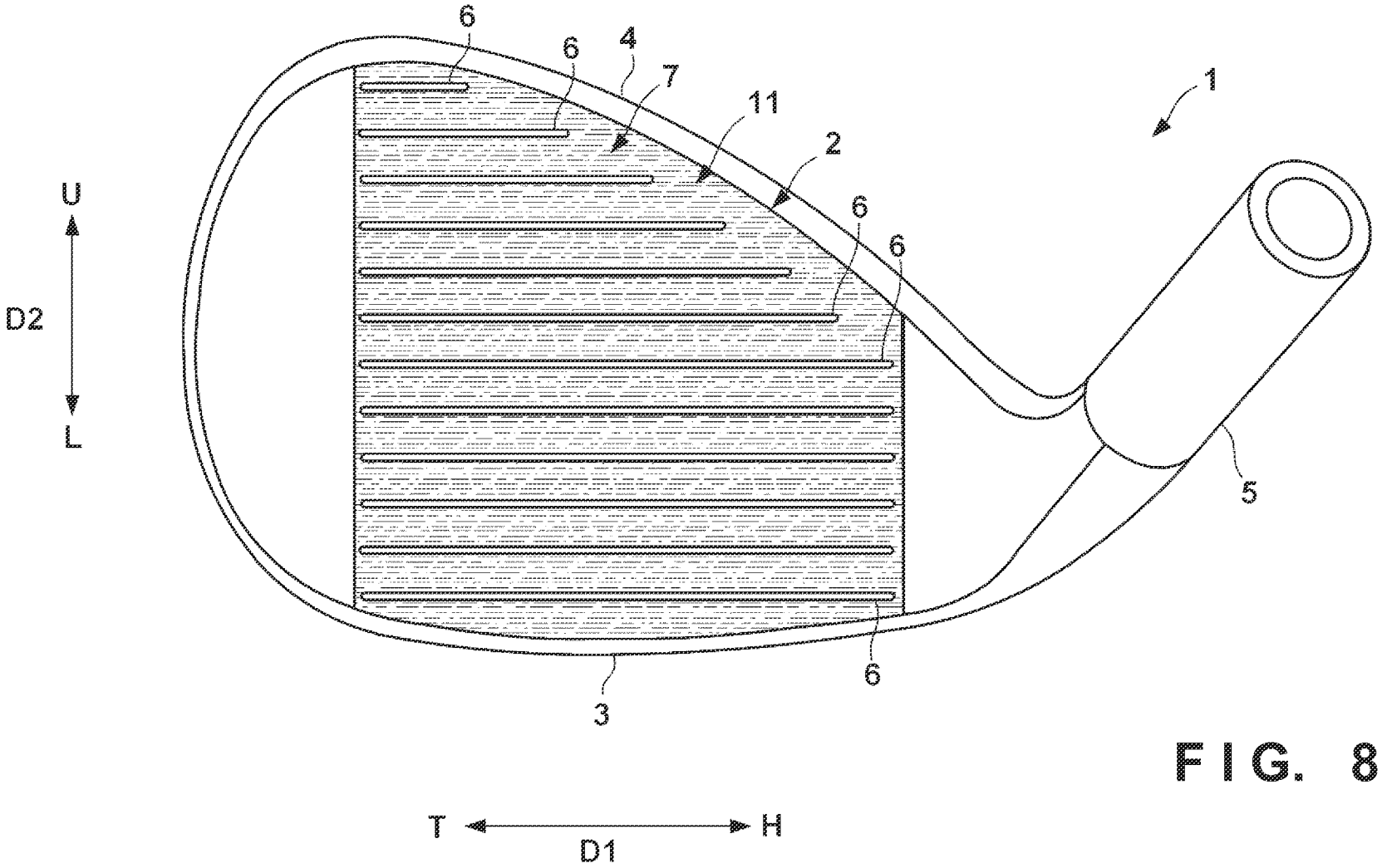
FIG. 8 is an external view of a golf club head having different basic pattern of concave portions.

When the plurality of concave portions 11 are formed in a continuous pattern, the basic pattern is not limited to the example shown in FIG. 6A. FIGS. 7 and 8 are external views of golf club heads 1 having different basic patterns.

Figure 9A:
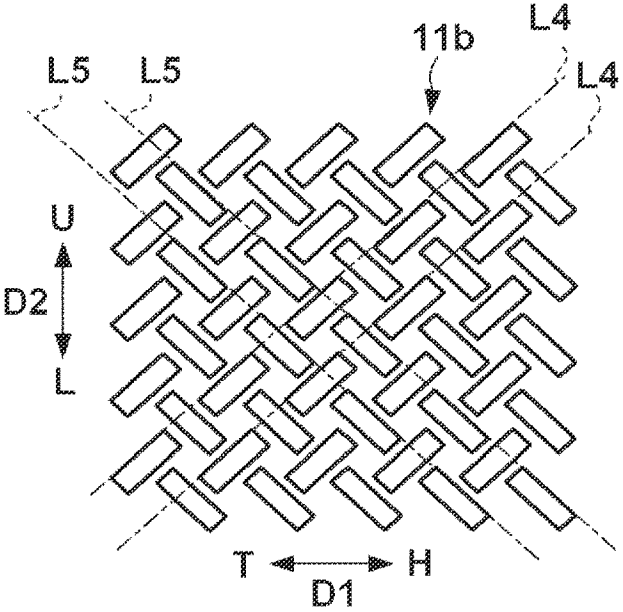
FIG. 9A is a view showing the basic pattern of the example shown in FIG. 7.

FIG. 9A shows a basic pattern of a plurality of concave portions 11 formed in a continuous pattern in the example shown in FIG. 7. The pattern shown in FIG. 9A is formed by using a symbol 11*b* as one unit and arranging the symbols 11*b* regularly in a D1 direction and a D2 direction. The concave portions 11 are formed in portions where this pattern overlaps a plurality of convex portions 7.

The symbol 11*b* is a polygon, particularly, a quadrangle, and more particularly, a parallelogram. Each side of the symbol 11*b* extends in a direction intersecting the D2 direction. Each of virtual lines L4 and L5 is a virtual line overlapping a long side of the symbol 11*b* and inclined with respect to the D1 direction. The plurality of concave portions 11 include concave portions located on the virtual lines L4 and L5. Note that the virtual line L4 is a virtual line inclined from the toe side to the heel side from the side of a leading edge 3 toward the side of a top line 4. The virtual line L5 is a virtual line inclined from the heel side to the toe side from the side of the leading edge 3 toward the side of the top line 4 and intersecting the virtual line L4. Even when striking a ball with the golf club head 1 while opening or closing a face portion 2 with respect to the target direction, a large change in the drainage performance of the face portion 2 can be prevented. In addition, when striking a ball while opening or closing the face portion 2 with respect to the target direction, the golf ball is easily caught by the edge of the concave portion 11, so that the spin performance can be improved.

The symbol 11*b* may be not a parallelogram but a rectangle or a square, and may be not a quadrangle but a triangle, a pentagon, a hexagon, a circle, or an oval.

Figure 9B:
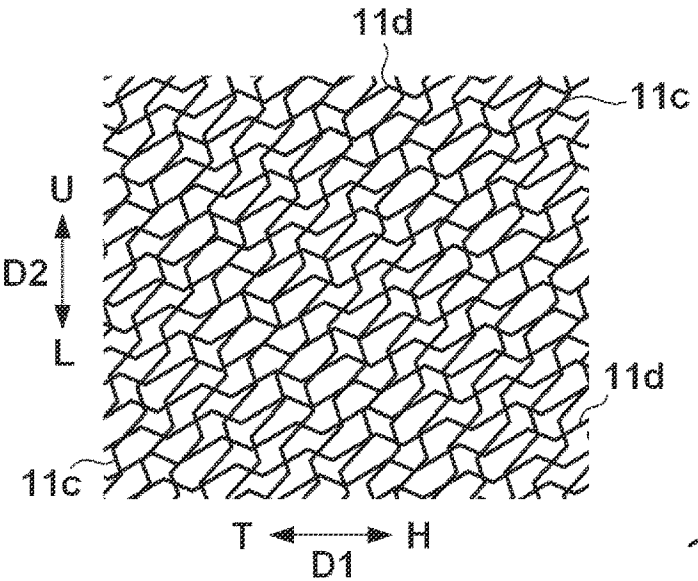
FIG. 9B is a view showing the basic pattern of the example shown in FIG. 8.
Figure 9C:
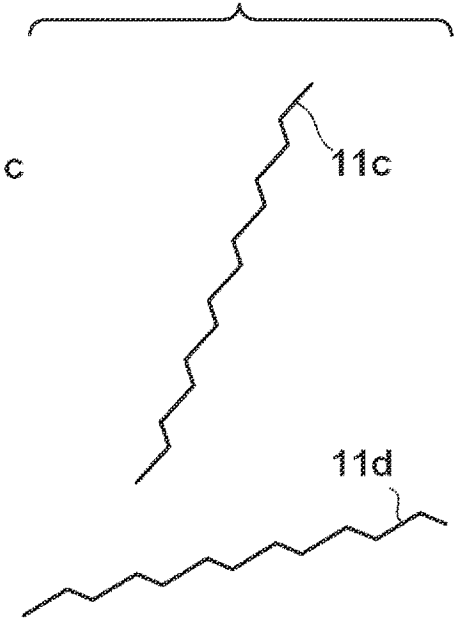
FIG. 9C is a view showing an example of polygonal lines forming the basic pattern shown in FIG. 9B.

Next, FIG. 9B shows the basic pattern of the plurality of concave portions 11 formed in the continuous pattern in the example shown in FIG. 8. The pattern shown in FIG. 9B is constituted by two kinds of polygonal lines 11*c* and 11*d* shown in FIG. 9C, each of which has regular bends. The pattern shown in FIG. 9B is formed by arranging a plurality of the polygonal lines 11*c* regularly in the D1 direction and arranging a plurality of the polygonal lines 11*d* regularly in the D2 direction. The concave portions 11 are formed in portions where this pattern overlaps the plurality of convex portions 7.

Each of the polygonal line 11*c* and the polygonal line 11*d* is generally inclined with respect to the D1 direction, and the inclination of the polygonal line 11*c* is different from the inclination of the polygonal line 11*d*. In the pattern shown in FIG. 9B, the polygonal line 11*c* and the polygonal line 11*d* intersect each other. Since the multiple polygonal lines 11*c* and polygonal lines 11*d* intersect each other, a network of water channels is formed, and the drainage performance can be improved.

Sixth Embodiment

Figure 10A:
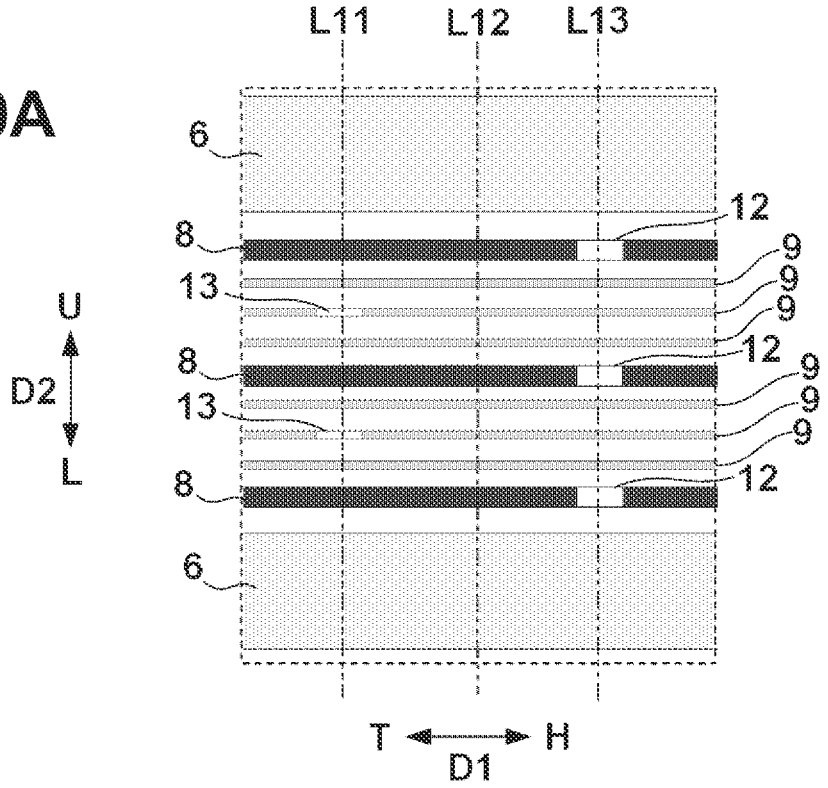
FIGS. 10A and 10B are views each for explaining an operation of quantifying the relationship between the number of convex portions and the number of concave portions and using it as an index.

In the third to fifth embodiment, by quantifying the relationship between the number of the convex portions 7 and the number of the concave portions 11 between adjacent two score lines 6 and using it as an index, the design efficiency of the golf club head 1 can be increased. FIG. 10A is a view for explaining an example. In the example shown in FIG. 10A, three arrays of convex portions 8 and six arrays of convex portions 9 are formed between adjacent two score lines 6. The total number of convex portions 7 is nine. In addition, three concave portions 12 and two concave portions 13 are formed.

At an arbitrary position in an D1 direction, a virtual reference line extending in a D2 direction is drawn so as to traverse the two score lines 6. Let X be the number of the convex portions 7 intersecting the virtual reference line, and Y be the number of concave portions 11 intersecting the virtual reference line. An index Z is set to Z=Y/X. In the example shown in FIG. 10A, three virtual reference lines L11 to L13 are exemplarily shown.

For the virtual reference line L11, the index Z=2/9≈0.22. For the virtual reference line L12, the index Z=0/9≈0. For the virtual reference line L13, the index Z=3/9≈0.33.

Figure 10B:
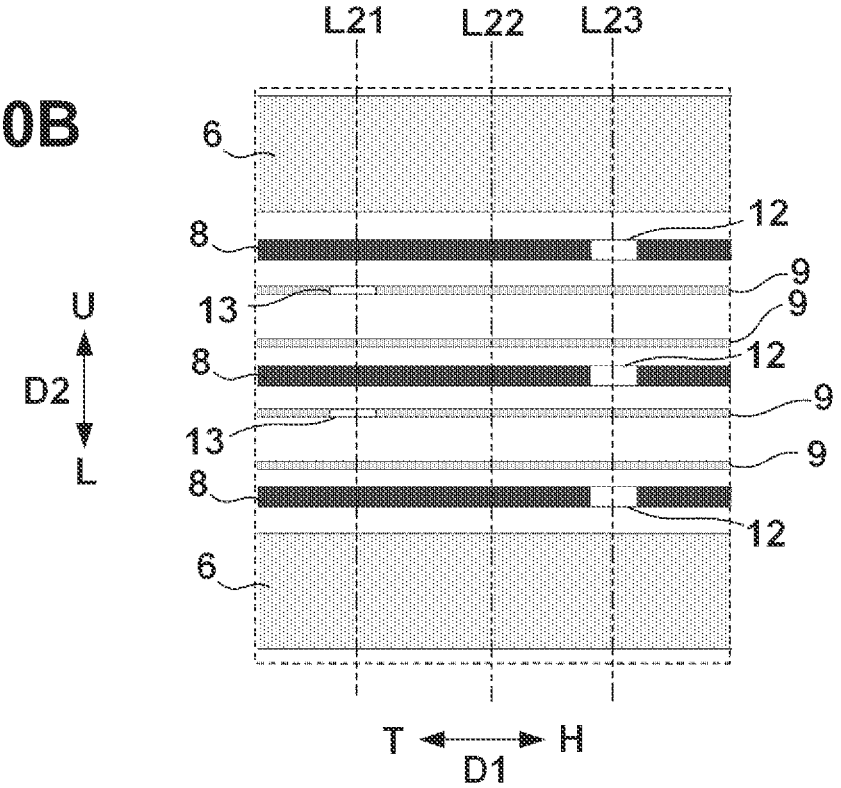

In the example shown in FIG. 10B, three arrays of the convex portions 8 and four arrays of the convex portions 9 are formed between the adjacent two score lines 6. The total number of the convex portions 7 is seven. In addition, three concave portions 12 and two concave portions 13 are formed. In the example shown in FIG. 10B, three virtual reference lines L21 to L23 are exemplarily shown.

For the virtual reference line L21, the index Z=2/7≈0.29. For the virtual reference line L22, the index Z=0/7≈0. For the virtual reference line L23, the index Z=3/7≈0.43.

In terms of the spin performance, the total number of the convex portions 7 between adjacent two score lines 6 is preferably seven or more. On the other hand, in terms of the space, drainage performance, and clogging between the adjacent two score lines 6, the total number of the convex portions 7 between the adjacent two score lines 6 is preferably nine or less. In terms of achieving both the drainage performance and the spin performance, it is preferable that a position with no concave portion 11, a position with a few concave portions 11, and a position with many concave portions 11 exist in the D2 direction. For example, as in the example shown in each of FIGS. 10A and 10B, it is preferable that a position with no concave portion 11 (L12 or L22), a position with a few concave portions 11 (L11 or L21), and a position with many concave portions 11 (L13 or L23) exist.

From the viewpoints as described above, when a virtual reference line is drawn at an arbitrary position in the D2 direction, it has one of indices Z1 to Z3 expressed as:

$Z1=0$;

$0.22<Z2<0.29$; or $0.33<Z3<0.43$

By setting the number of the convex portions 7 and the number of the concave portions 11 in the D2 direction so as to satisfy these three index ranges alone and setting a distance S in the D1 direction between arbitrary concave portions 11 adjacent to each other on the same convex portion 7 to 10 mm or less as described above, a surface structure that further suppresses a deviation of the spin performance depending on the striking position and a deviation of the drainage performance can be obtained.

Seventh Embodiment

A formation method of convex portions 7 and concave portions 11 will be described next. As a golf club head 1, for example, a primary molded product without the convex portions 7 and the concave portions 11 is manufactured by forging or casting. Then, the convex portions 7 and the concave portions 11 are formed in the primary molded product. After that, coating and a surface treatment are performed to complete the golf club head 1. The primary molded product may be formed with or without score lines 6. When the primary molded product includes no score line 6, it is possible to form the score lines 6 upon forming the convex portions 7 and the concave portions 11. The primary molded product may be formed from a single member or multiple members. When the primary molded product is formed from multiple members, it may be formed from, for example, a face forming member which forms a face portion 2 and a head body which forms the part other than the face portion 2. In this case, the face forming member and the head body may be combined after the convex portions 7 and the concave portions 11 are formed in the face forming member.

Figure 11A:
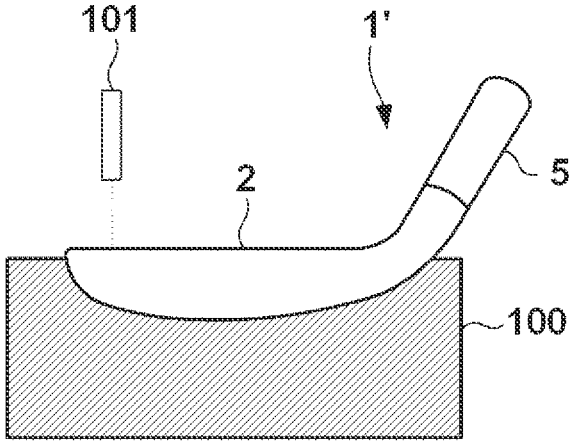
FIGS. 11A to 11C are views showing an example of a manufacturing method of a golf club head.
Figure 11B:
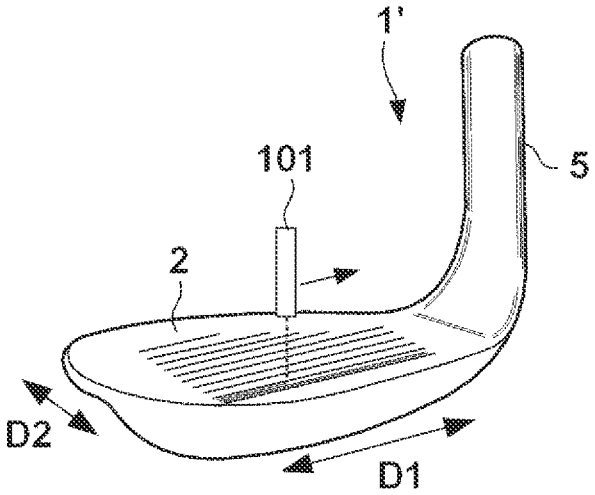

The convex portions 7 and the concave portions 11 can be formed by laser processing or cutting. FIGS. 11A and 11B exemplify a case in which the convex portions 7 and the concave portions 11 are formed by laser processing. A primary molded product 1' in which the convex portions 7 and the concave portions 11 are to be formed is fixed to a laser irradiation device (not shown) via a jig 100. The laser irradiation device includes an irradiation unit 101 which emits laser light. The convex portions 7 and the concave portions 11 can be formed while irradiating the face portion 2 with laser light emitted by the irradiation unit 101, and relatively moving the face portion 2 (primary molded product 1') or irradiation unit 101.

Figure 11C:
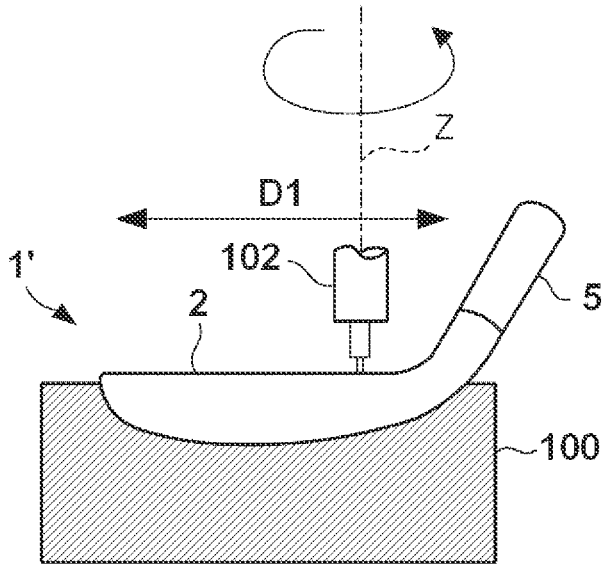

FIG. 11C exemplifies a case in which the convex portions 7 and the concave portions 11 are formed by cutting. The primary molded product 1'is fixed to an NC milling machine via the jig 100. The NC rotatably driven about the Z-axis, and a cutting tool (end mill) is attached to the lower end of the spindle 102. As in the case of laser processing, the convex portions 7 and the concave portions 11 are formed while relatively moving the face portion 2 (primary molded product 1') or cutting tool.

Note that after the formation of the convex portions 7 and the concave portions 11, a surface treatment for increasing the hardness of the face portion 2 is preferably performed. Examples of such a surface treatment are a carburizing treatment, nitriding treatment, soft nitriding treatment, PVD (Physical Vapor Deposition) treatment, ion plating, DLC (Diamond-Like Carbon) treatment, and plating treatment. Especially surface treatments such as a carburizing treatment and nitriding treatment, which modify the surface without forming another metal layer on the surface, are preferable. The surface of the face portion 2 may be covered with a plating layer.

The invention is not limited to the foregoing embodiments, and various variations/changes are possible within the spirit of the invention.

What is claimed is:

1. A golf club head comprising:

a face portion;

a plurality of score lines formed in the face portion and extending in a toe-heel direction; and a plurality of convex portions formed in the face portion, projecting from a reference plane which includes edges of each of the plurality of score lines, and extending in the toe-heel direction, wherein the plurality of convex portions include a first convex portion and a second convex portion formed between adjacent score lines, both a projecting height of the first convex portion and a width in an orthogonal direction of the toe-heel direction of the first convex portion are larger than those of the second convex portion, a plurality of concave portions recessed on a side of the reference plane in a projecting height direction of the convex portion are formed in the plurality of convex portions, and the plurality of concave portions includes a concave portion having a bottom surface above the reference plane in the projecting height direction.

2. The golf club head according to claim 1, wherein seven to nine arrays of the first convex portions and the second convex portions in total are formed between adjacent score lines.

3. The golf club head according to claim 1, wherein a distance in the toe-heel direction between the concave portions adjacent to each other on the same convex portions is not more than 10 mm.

4. The golf club head according to claim 1, wherein the plurality of concave portions include a plurality of concave portions located on a virtual line inclined with respect to the orthogonal direction.

5. The golf club head according to claim 1, wherein the plurality of concave portions include a plurality of concave portions located on a plurality of virtual lines inclined with respect to the orthogonal direction, and the plurality of virtual lines include a first virtual line inclined from a toe side to a heel side from a leading edge side toward a top line side, and a second virtual line inclined from the heel side to the toe side from the leading edge side toward the top line side and intersecting the first virtual line.

6. The golf club head according to claim 1, wherein the plurality of concave portions are formed in a continuous pattern.

7. The golf club head according to claim 1, wherein the plurality of concave portions are formed in a continuous pattern of symbols.

8. The golf club head according to claim 1, wherein the plurality of concave portions are formed in a continuous pattern of polygons.

9. The golf club head according to claim 1, wherein the plurality of concave portions are formed in a continuous pattern of polygonal lines having regular bends.

10. The golf club head according to claim 1, wherein the plurality of concave portions are formed in a continuous pattern of a plurality of polygonal lines having regular bends, and the plurality of polygonal lines include a first polygonal line and a second polygonal line intersecting the first polygonal line.

11. The golf club head according to claim 3, wherein if a virtual line is drawn in the orthogonal direction so as to traverse between the adjacent score lines, X represents the number of intersections between the virtual line and the convex portions, and Y represents the number of intersections between the virtual line and the concave portions, the virtual line at an arbitrary position in a toe-heel direction satisfies one of $Y/X=0$, $0.22<Y/X<0.29$, or $0.33<Y/X<0.43$.

* * * * *